US005649782A

United States Patent [19]

Fröhlich et al.

[11] Patent Number: 5,649,782

[45] Date of Patent: Jul. 22, 1997

[54] TRANSPORT ANCHOR ESPECIALLY FOR PREFABRICATED CONCRETE PARTS AND LOAD BEARING MEMBER TO BE SCREWED INTO THE TRANSPORT ANCHOR

[75] Inventors: Klaus Fröhlich; Ernst Peppel, both of Pforzheim, Germany

[73] Assignee: Halfen GmbH & Co. KG, Düsseldorf, Germany

[21] Appl. No.: 494,055

[22] Filed: Jun. 23, 1995

[30] Foreign Application Priority Data

Jun. 23, 1994 [EP] European Pat. Off. ..... 94109706

[51] Int. Cl.[6] ..... E04G 21/14

[52] U.S. Cl. ..... 403/301; 403/10; 403/27; 403/306; 52/125.1; 52/125.5; 411/378

[58] Field of Search ..... 403/306, 308, 403/301, 300, 299, 10, 27, 33; 52/704, 705, 125.1, 125.5, 125.6, 125.4, 125.2; 411/401, 378; 294/89

[56] References Cited

U.S. PATENT DOCUMENTS

| | | | |
|---|---|---|---|
| 1,899,531 | 2/1933 | Seifner | 403/301 X |
| 2,210,441 | 8/1940 | Bachman | 52/705 |
| 2,630,341 | 3/1953 | Downey | 403/301 X |
| 4,079,983 | 3/1978 | Van Mastrigt | 52/125.5 X |
| 4,437,276 | 3/1984 | Goldberg | 52/125.5 |
| 5,261,198 | 11/1993 | McMillan | 52/125.5 X |
| 5,501,542 | 3/1996 | Hall, Sr. | 403/300 X |

FOREIGN PATENT DOCUMENTS

| | | | |
|---|---|---|---|
| 756325 | 4/1969 | Canada | 52/125.5 |
| 19922 | 12/1980 | European Pat. Off. | 52/125.5 |
| 0118002 | 9/1984 | European Pat. Off. . | |
| 0132815 | 2/1985 | European Pat. Off. . | |
| 457974 | 7/1913 | France | 52/704 |
| 1913912 | 10/1970 | Germany | 52/125.5 |
| 1961879 | 6/1971 | Germany | 52/125.5 |
| 2159732 | 6/1973 | Germany . | |
| 3329374 | 2/1985 | Germany | 52/125.5 |

*Primary Examiner*—Harry C. Kim
*Attorney, Agent, or Firm*—Robert W. Becker & Associates

[57] ABSTRACT

A transport anchor for transporting a heavy part, which anchor is embedded in the heavy part, includes a sleeve having an inner thread for receiving a load bearing member. The sleeve has a first section with an exterior end face positioned flush with the exterior surface of the heavy part. The sleeve has a second section with a receiving member for an anchoring element of the heavy part. A first plug with an outer thread is threaded into the inner thread of the sleeve and is moveable along the inner thread. The first plug has a plug end face facing outwardly relative to the heavy part. The load bearing member can frictionally engage the plug end face of the first plug. The load bearing member has a base body with an outer thread for cooperation with the inner thread of the sleeve. The base body has a first end for insertion into the sleeve, whereby the first end has an end face with an axial recess or an axial projection providing at least one matching contact surface for cooperation with the at least one axial contact surface at the plug.

18 Claims, 3 Drawing Sheets

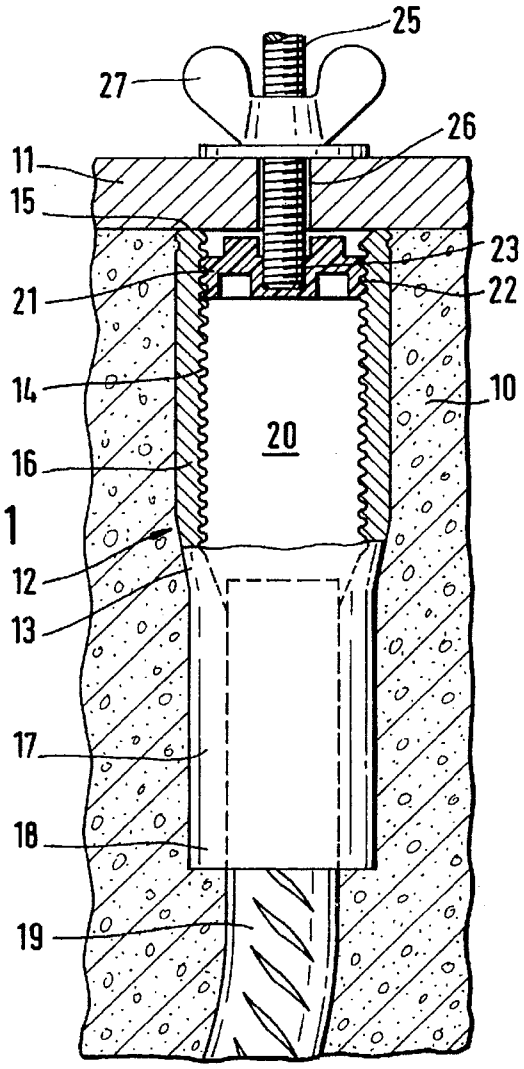
Fig. 1
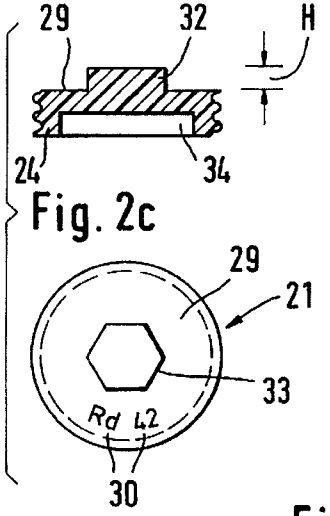
Fig. 2a
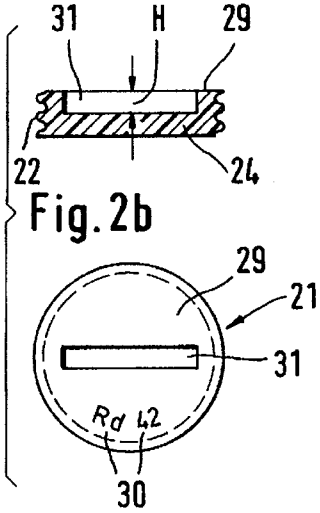
Fig. 2b
Fig. 2c
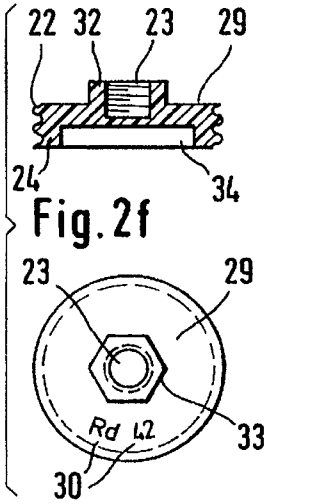
Fig. 2d
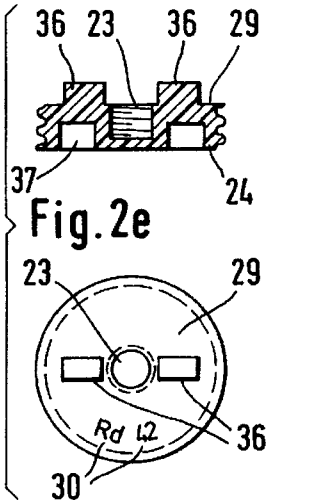
Fig. 2e
Fig. 2f Fig.3a
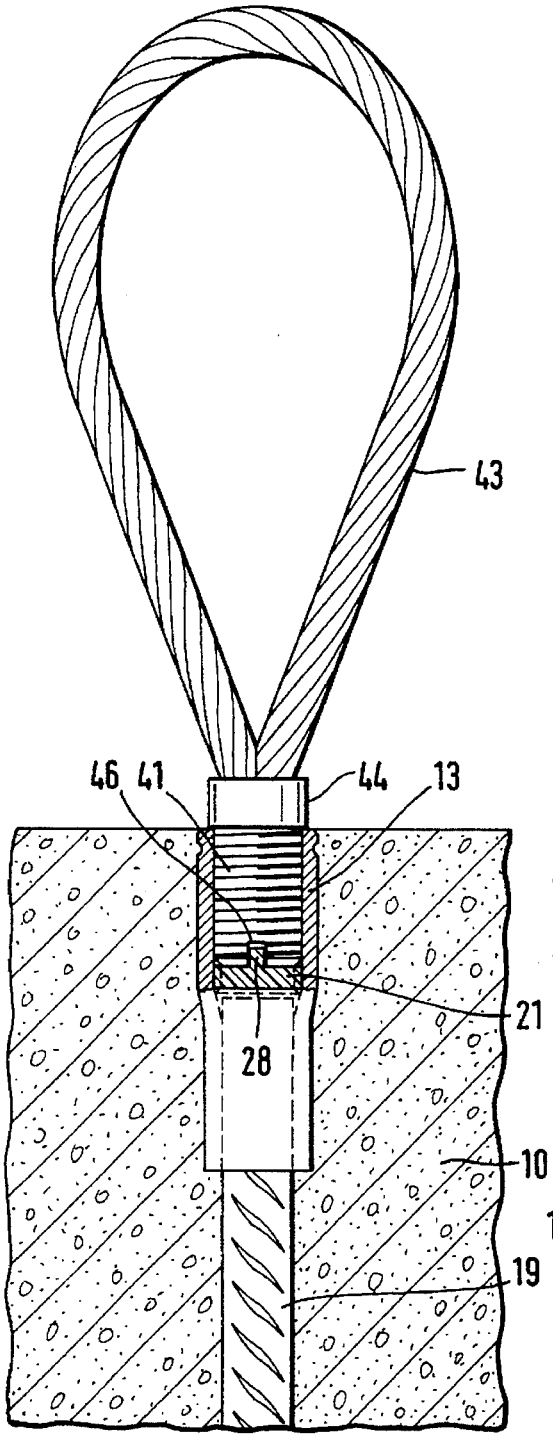
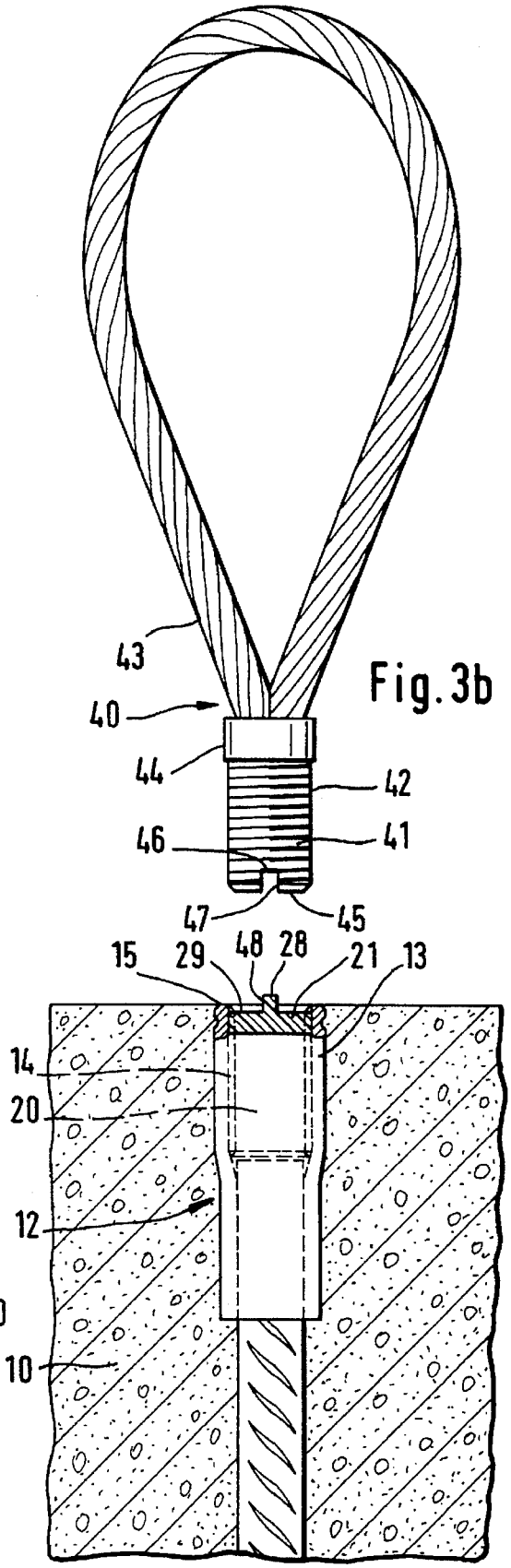
Fig.3b

TRANSPORT ANCHOR ESPECIALLY FOR PREFABRICATED CONCRETE PARTS AND LOAD BEARING MEMBER TO BE SCREWED INTO THE TRANSPORT ANCHOR

BACKGROUND OF THE INVENTION

The present invention relates to a transport anchor, especially for heavy parts such as prefabricated concrete parts, comprised of a sleeve with an inner thread for receiving a load bearing member, whereby the sleeve has an end face flush with the exterior side of the part to be transported and has its other end means for connecting thereto reinforcement members or anchoring members, and further relates to a load bearing member screwed into the transport anchor.

From European publication 0 118 002 a transport anchor for prefabricated concrete parts is known which is comprised of a sleeve with an inner thread for screwing therein a load bearing member. The end of the sleeve which is embedded within the prefabricated concrete part is pressed onto the end of a ribbed concrete steel (reinforcement bar) so that upon pouring concrete the producing the prefabricated concrete part no concrete can enter the sleeve. At the end face of the reinforcement bar a spring element is provided the forward end of which comprises a disk or similar means the surface of which corresponds substantially to the inner cross-section of the sleeve. Upon screwing the load bearing member into the sleeve, this disk is moved counter to the force of the spring into the sleeve and upon removing the load bearing member the spring returns the disk into its initial position in which it is substantially flush with the forward edge of the sleeve.

With the known arrangement the disk, on the one hand, serves as a marker for displaying the respective load capacity and, on the other hand, is designed to prevent dirt from entering the sleeve. In order to prevent a jamming of the disk within the sleeve in a secure manner, it is necessary to provide sufficient radial play so that a tight sealing of the interior of the sleeve against the exterior is not possible. Because of due to the remaining annular gap, dirt particles and especially moisture can enter the sleeve so that difficulties, when screwing the respective load bearing member into the sleeve, can not be avoided. Especially upon storing the prefabricated concrete parts for an extended period of time, it can not be avoided that the interior hollow space behind the disk fills with dirt so that a submerging of the disk into the sleeve is prevented.

It is therefore an object of the present invention to provide a transport anchor of the aforementioned kind in which the forward end of the sleeve is tightly sealed and the closure is automatically actuated with the aid of the load bearing member.

SUMMARY OF THE INVENTION

The transport anchor for transporting a heavy part, the transport anchor embedded in the heavy part, according to the present invention is primarily characterized by:

a sleeve having an inner thread for receiving a load bearing member, the sleeve having a first section with an exterior end face positioned flush with an exterior surface of the heavy part, and the sleeve having a second section comprising means for receiving an anchoring element of the heavy part; and the first plug, having an outer thread, threaded into the inner thread of the sleeve and moveable along the inner thread, the first plug having a plug end face facing outwardly relative to the heavy part, the plug end face of the first plug having means for frictionally engaging a screwing member.

Preferably, the means for fictionally connecting comprises at least one contact surface extending in the exterior direction of the sleeve for cooperating with a matching surface of the screwing member. The screwing member is preferably the load bearing member.

Advantageously, the first plug further comprises at least one elongate projection projecting symmetrically from the plug end face and wherein two of the contact surfaces are provided at the at least one elongate projection.

Advantageously, the first plug further comprises a blind hole extending from the plug in face into the first plug, the blind hole having an inner thread.

In another embodiment of the present invention, the first plug further comprises a hexagonal projection projecting from the plug end face so as to be symmetrical relative to a center axis of the first plug. The contact surfaces are provided at the hexagonal projection. Preferably, the first plug further comprises a blind hole extending from the plug end face into the first plug, the blind hole having an inner thread.

Expediently, the height of the at least one contact surface in the axial direction is at least 1.1 times the pitch of the outer thread.

Preferably, the height is 1.5 to 2.0 times the pitch of the outer thread.

In yet another embodiment of the present invention, the first plug is an injection-molded plastic part and the outer thread has the length of at least 2 turns.

Preferably, the plug end face comprises markings indicating the thread size of the inner thread of the sleeve and the load capacity of the transport anchor.

Expediently, the inner thread begins at the exterior end face and extends within the first section over a portion of the length of the sleeve end. The second section, comprising the means for receiving the anchoring element of the heavy part, is without inner thread. Preferably, the transport anchor further comprises a second plug positioned at an end of the inner thread adjacent to the second section. The second plug is fixedly connected within the sleeve. The means for receiving the anchoring element of the heavy part in this embodiment is comprised of two diametrically opposed bores.

Advantageously, the inner thread extends over the entire length of the sleeve and the means for receiving an anchoring element is in the form of a portion of the inner thread provided at the second section.

The present invention further relates to a load bearing member for transporting a heavy part provided with a transport anchor in the form of a sleeve having an inner thread and a first section with an exterior end face positioned flush with the exterior surface of the heavy part. The transport anchor comprises a plug having an outer thread threaded into the inner thread of the sleeve and moveable along the inner thread. The plug has a plug end face facing outwardly relative to the heavy part. The plug end face comprises at least one axial contact surface extending in the axial direction of the sleeve whereby the load bearing member comprises:

a base body with an outer thread for cooperation with an inner thread of the sleeve; and the base body having a first end for insertion into the sleeve, the first end having an end face with an axial recess providing at least one matching contact surface for cooperation with the at least one axial contact surface at the plug.

Preferably, the end face of the first end of the base body comprises a groove extending along a diameter of the base body and the at least one matching contact surface of the base body is provided at the inner sidewalls of the groove.

Preferably, the load bearing member further comprises a cable loop, wherein the base body has a second end and is a partially hollow bolt, wherein the second end comprises an opening and the cable loop is fastened to the opening.

In another embodiment of the load bearing member a base body with an outer thread for cooperation with an inner thread of the sleeve is provided, wherein the base body has a first end for insertion into the sleeve, the first end having an end face with an axial projection providing at least one matching contact surface for cooperation with the at least one axial contact surface at the plug.

The primary advantage of the inventive transport anchor is to be seen in the feature that the plug covers the entire cross-section of the opening of the sleeve, including the threads and that the plug can be returned without the need for a spring means by a screwing member, respectively, the load bearing member into its initial position.

In a preferred embodiment of the invention a frictional connection is achieved by providing at the plug at least one contact surface extending in the axial direction of the sleeve which cooperates with a matching contact surface of the load bearing member to be screwed into the sleeve. This results in a frictional connection between the plug and the load bearing member in the directional of rotation so that, corresponding to the orientation of rotation of the load bearing member, the plug is also turned, independent of the respective rotational direction. When upon removal of the load bearing member from the sleeve its last thread turn leaves the inner thread of the sleeve and is axially withdrawn, the plug, of course, remains in the forward position relative to the sleeve assumed at this moment.

It is especially expedient that two contact surfaces are provided which are formed by at least one elongate projection that is symmetrically arranged on the end face of the plug. In this manner a symmetrical force introduction into the plug is achieved so that transverse forces are avoided and the tendency for jamming is reduced. In order to minimize the rotational angle until engagement of the respective contact surfaces of load bearing member and plug occurs, it is expedient that the contact surfaces are provided at a hexagonal projection positioned concentric to the central axis of the plug. In this manner at most an angular displacement of 60 degrees is needed before an engagement of load bearing member and plug takes place so that subsequently a synchronous rotation of both parts occurs.

The plug may also serve to receive positioning pins or fasting screws as auxiliary means for securing the mold parts during pouring of concrete for producing the concrete part. For this purpose, the plug is provided with a blind hole with inner thread whereby the opening of the blind hole is positioned at the forward plug end face. In order to ensure a sufficient axial play relative to the plug upon insertion of the load bearing member for screwing it into the inner thread of the sleeve, the height of the contact surfaces (in the axial direction) should be at least 1.1 times per preferably 1.5 to 2.0 times the pitch between adjacent thread turns.

The plug can be manufactured in an especially simple manner as a injection-molded plastic part whereby the shaping of the surfaces, i.e., bottom and top side, can be designed in multiple shapes by correspondingly designing the injection mold. For exactly guiding the sleeve within the inner thread, the exterior thread of the plug should have a length of at least 2 turns. The use of plastic as a material for the plug is advantages with respect to material cost. At the plug end face of the plugs it is advantageous to provide markings for indicating the characteristics of the inner thread of the sleeve, i.e., shape, pitch and size of the thread as well as loading capacity. Besides plastic it is also possible to use materials that are weather-resistant and corrosion-free for the plugs of the present invention.

The inner thread of the sleeve should extend only over a portion of the entire length of the sleeve. The section of the sleeve without thread is designed for connecting thereto the reinforcement bar or rip steel. For connecting the device with a ribbed concrete steel, the ribbed concrete steel is introduced from the end face into the rearward end of the sleeve and the second section of the sleeve without thread is forced onto the ribbed concrete steel. When using a reinforcement bar it is advantageous that within the second section of the sleeve without thread two diametrically opposed bores are provided and that a further plug is provided at the end of the second section without threads. This plug is fastened, especially pressed, into the sleeve so as to be fixable connected thereto. Due to this second plug a wall is formed at the inner end of the inner thread through which the introduction of concrete into the threaded interior of the sleeve during pouring of the concrete part is prevented.

The present invention further provides a load bearing member for sleeve-type transport anchors which in a simple manner upon threading into or out of the sleeve synchronously rotates the plug in both directions. This load bearing member is characterized in that it is provided at its end face facing the transport anchor with at least one axial recess, respectively, a projection by which an axially extending contact surface is formed which cooperates with a corresponding contact surface at the plug end face. Expediently, the end face is provided with a groove whereby the contact surfaces are formed by the inner sidewalls of the groove and the groove preferably extends along the diameter of the load bearing member. This embodiment is especially preferred because retro-fitting of already present load bearing members is possible without problems by simply providing the leading end face (end face to be inserted into the sleeve) with a groove extending along the diameter of the base body.

BRIEF DESCRIPTION OF THE DRAWINGS

The object and advantages of the present invention will appear more clearly from the following specification in conjunction with the accompanying drawings, in which:

FIG. 1 shows a longitudinal section of a transport anchor pressed onto ribbed concrete steel within a prefabricated concrete part;

FIGS. 2*a*–2*f* each show an axial section and a plan view of various embodiments of the plug;

FIGS. 3*a* and 3*b* show a transport anchor and a load bearing member in connected and detached states, respectively.

DESCRIPTION OF PREFERRED EMBODIMENTS

Figure 4:
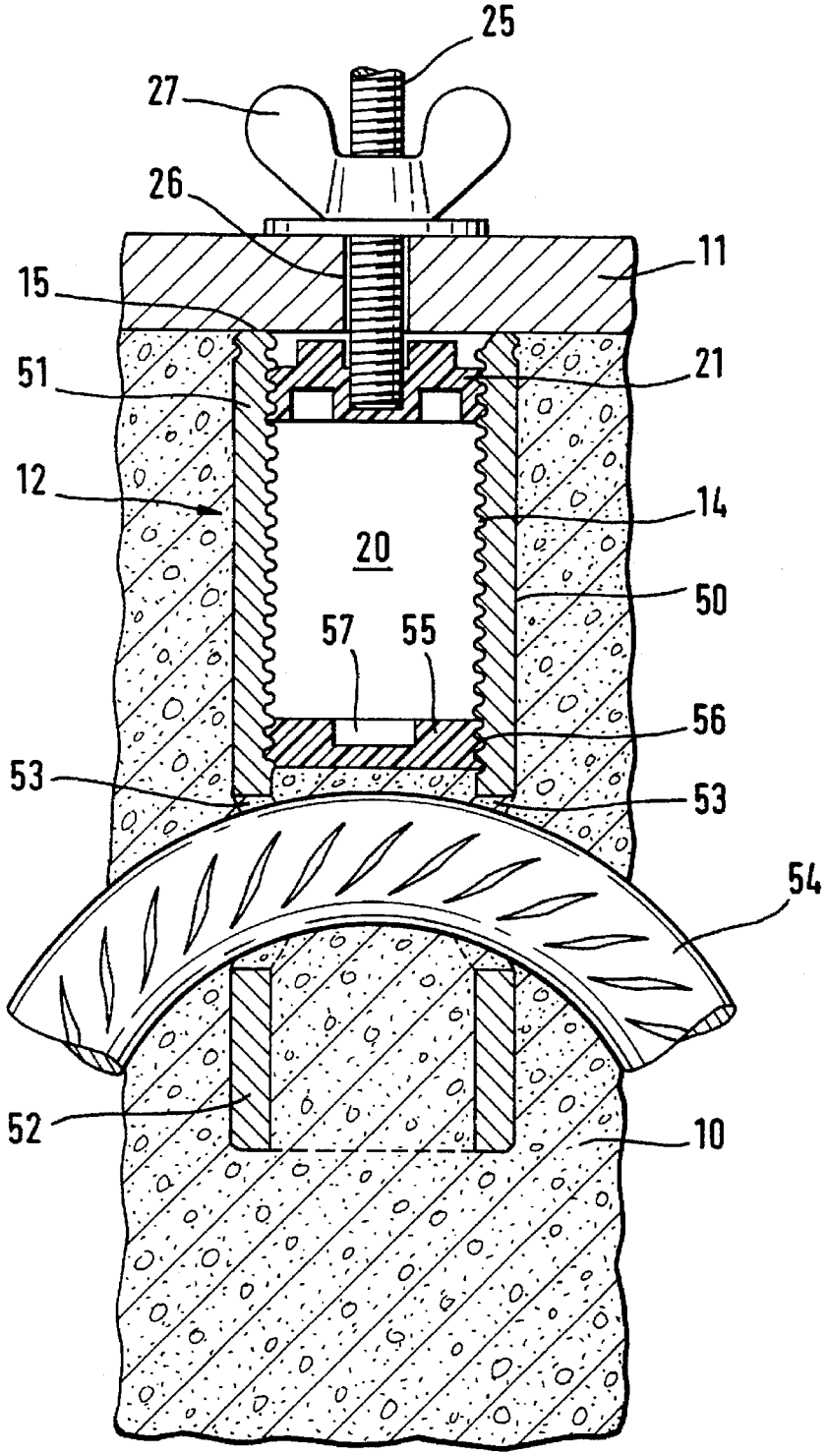
FIG. 4 shows a longitudinal section of a transport anchor with a reinforcement bar.

The present invention will now be described in detail with the aid of several specific embodiments utilizing FIGS. 1 through 4.

In FIG. 1 a portion of a prefabricated concrete part 10 during manufacture is represented. The mold is closed off by a casing plate 11 at which the end face 15 of the transport anchor 12, which is comprised essentially of a sleeve 13 with an inner thread 14, rests. The sleeve 13 comprises a first section 16 in which the inner thread 14 is provided and a second section 17 which has a smooth inner contour without thread. Into the end 18, which extends into the prefabricated concrete part 10, a ribbed concrete steel 19 (anchoring element) is inserted onto which the section 17 of the sleeve 13 is pressed. This results in a tight connection that prevents that the still liquid, respectively, flowable concrete can penetrate into the hollow interior 20 of the sleeve 13.

In the vicinity of the end face 15 of the sleeve 13 a plastic plug 21 with exterior thread 22 is positioned. The outer thread 22 matches exactly the inner thread 14 of the sleeve 13. The plastic plug 21 is provided with a blind hole 23 with an inner thread. Into the inner thread a threaded bolt 25 can be screwed. The threaded bolt 25 extends through an opening 26 of the casing plate 11 so that the transport anchor 12 can be positioned in a predetermined position and can be secured with a wing nut 27 that is screwed onto the exterior end of the threaded bolt 25. With this measure it is ensured that the transport anchor 12 can not be displaced during filling of the mold with concrete or upon shaking for the purpose of compacting the concrete.

FIGS. 2*a*–2*f* show different embodiments of plastic plugs whereby the example of FIG. 2*e* corresponds to the one shown in FIG. 1. Each one of the representations of FIGS. 2*a*–2*f* shows an axial cross-sectional view as well as a plan view of the plastic plug 21. In the example of FIG. 2*a* the plastic plug 21 has a disk-shaped base body 24 the upper end face 29 of which is provided with an elongate projection 28 arranged symmetrical to the center axis of the disk-shaped base body 24. Since the elongate projection 28 occupies only a small portion of the total surface area of the end face 29, there is sufficient space at the end face for providing markings 30. These markings 30, may, for example, provide information about the size and shape of the thread 14 of the transport anchor 12 represented in FIG. 1 as well as information on the loading capacity, respectively, the size of the load. The markings 30 are provided within the injection mold for producing the plastic plug 21 so that upon manufacturing the plastic plug 21 without any further expenditure the markings 30 are produced. In this manner the marking 30 is fixedly and permanently connected to the plastic plug 21 so that any mistakes which could occur upon subsequent application of markings 30 are prevented.

FIG. 2*b* shows the plastic plug 21 which at its end face 29 is provided with an elongate recess 31. In the embodiment of FIG. 2*c* the disk-shaped base body 24 is provided at its end face 29 with a projection 32 in of hexagonal cross-section 33 whereby the hexagon 33 is arranged concentrically to center axis of the center plug 21. At the underside of the disk-shaped base body 24 a cylindrical recess 34 is provided so that the volume of the plastic plug 21 is reduced and thus the amount required for manufacture is also reduced. In FIGS. 2*a*, 2*b*, and 2*c* the axial extension of the contact surfaces, which are provided by the projections 28, 32 or the recesses 31, of the plastic plug 21 is indicated as height H. This height should be no less than 1.1 times the pitch between adjacent thread turns. It is especially preferred that the height H is 1.5–2.0 times of the pitch.

FIG. 2*d* shows a plastic plug 21 which along its longitudinal axis is provided with a blind hole 23 with inner thread 35. The forward opening of the blind hole 23 is provided at the plug end face 29 of the disk-shaped base body 24. Adjacent to the blind hole 23 diametrically oppositely arranged projections 36 are provided which project from the plug end face 29 to the same amount as the projection 28 in FIG. 2*a*. In this embodiment there is also enough surface area provided for markings 30. The embodiment in FIG. 2*e* differs from the embodiment shown in FIG. 2*d* only in that the underside of the disk-shaped body 24 is provided with an annular recess 37 that serves to reduce the volume of the plastic plug 21. The embodiment of FIG. 2*f* is similar to the one described in connection with FIG. 2*c* and it differs from this embodiment only by the additional application of a blind hole 23 within the projection 32 with hexagonal cross-section 33.

FIGS. 3*a* and 3*b* show the transport anchor 12 in cooperation with a load bearing member 40. The load bearing member 40 is comprised of a base body in the form of a partially hollow bolt 41 with an exterior thread 42 and a cable loop 43 connected within the opening of bolt 41. The cable loop 43 consists of a steel cable. The end of the bolt 41 which surrounds the opening for receiving the cable loop 43 is in the form of a radial collar 44. In the area of the end facing the transport anchor 12, the bolt 41 is of massive (solid) construction whereby at the end face 44 an elongate recess in the form of a groove 46 is provided. The width of the groove 46 is dimensioned such that it can receive the elongate projection 28 of the plastic plug 21.

For fastening the load bearing member 40 it is placed with end face 45 of the bolt 41 onto the plug end face 29 of the plastic plug 21 which is positioned at the forward end face 15 of the transport anchor 12. By doing so, the elongate projection 28 and the groove 46 are brought into engagement so that the sidewalls 47 of the groove 46 and the sidewalls 48 of the elongate projection 28 are brought into abutment. Due to this positive locking engagement, surfaces 47 and 48 extending in the axial direction of the sleeve 13 of the transport anchor 12 are provided via which, upon rotation of bolt 41, the rotational movement is transmitted onto the plastic plug 21. By screwing the bolt 41 of the load bearing member 40 into the inner thread 13, the plastic plug 21 is thus synchronously rotated so that it frees access to the hollow interior 20 of the sleeve 13 for receiving therein the bolt 41. The length of the inner thread 14 is dimensioned such that the bolt 41 of the load bearing member 40 can be threaded to such an extent that the collar 44 abuts the end face 15 of the sleeve 13. This is represented in FIG. 3*a*.

For detaching the load bearing member 40 from the transport anchor 12, the bolt 41 is screwed out of the inner thread 14 whereby due to the coupling of the projection 28 with the groove 46 the plastic plug 21 follows the rotation of the bolt 41. As soon as the bolt 41 has been completely removed from the sleeve 13, the plastic plug 21 remains at the forward end of the sleeve 13 and prevents thus introduction of dirt into the interior space 20 of the transport anchor 12.

The embodiment represented in FIG. 4 differs from the embodiment in FIG. 1 only with respect to the type of the reinforcement (anchoring element) of the transport anchor 12 in the prefabricated concrete part 10. This transport anchor 12 is comprised of a sleeve 50 with a first section 51 that is provided with an inner thread 14 and with a second section 52 with a smooth inner wall without thread. The section 52 without thread comprises two diametrically opposed bores 53 through which the anchoring element in the form of a reinforcement bar 54 extends. Within the first section 51 with a thread 14 a second plug 55 is provided which has also an outer thread 56 whereby this second plug 55 is threaded until it reaches the inner end of the inner thread 14. In order to be able to engage this plug 55 with a threading tool, the second plug 55 is provided with a recess 57 for example, in the form of a slot. The second plug 55 seals the hollow interior 20 within the sleeve 50 and prevents thus the introduction of concrete during pouring of the prefabricated concrete part. Otherwise, the embodiment of FIG. 4 corresponds to the embodiment of FIG. 1 so that for further details references is made to the above description of FIG. 1.

A further embodiment which is not represented in the drawings comprises a sleeve having an inner thread over the entire axial length. The inner end of the sleeve positioned within the prefabricated concrete part can thus be provided, before filling the mold with concrete, with a threadable anchoring element.

The present invention is, of course, in no way restricted to the specific disclosure of the specification and drawings, but also encompasses any modifications within the scope of the appended claims.

What we claim is:

1. A transport anchor for transporting a prefabricated concrete part, said transport anchor comprising:

a sleeve, having an inner thread, for embedding in the prefabricated concrete part;

a rod-shaped anchoring element for embedding in the prefabricated concrete part;

said sleeve having a first cylindrical section with an exterior end face for positioning flush with an exterior surface of the prefabricated concrete part;

said sleeve having a second section and said anchoring element fixedly connected in said second section;

a first plug having a disk-shaped base body with an outer thread, said first plug threaded into said inner thread of said sleeve;

said first plug comprised of a plastic material;

said first plug having a plug end face facing away form said second section;

said plug end face comprising a marking formed of said plastic material and indicating a load capacity of said transport anchor;

said plug end face having first engaging means for engaging a screwing member of a load bearing member for bearing the prefabricated concrete part for axially moving said first plug within said sleeve when engaged and turned by the screwing member, having a second engaging means matching said first engaging means.

2. A transport anchor according to claim 1, wherein said first engaging means comprises at least one contact surface extending in an axial direction of said sleeve for cooperating with a matching surface of the screwing member.

3. A transport anchor according to claim 2, wherein said first plug further comprises at least one elongate projection projecting symmetrically from said plug end face and wherein two of said contact surfaces are provided at said at least one elongate projection.

4. A transport anchor according to claim 3, wherein said first plug further comprises a blind hole extending from said plug end face into said first plug, said blind hole having an inner thread.

5. A transport anchor according to claim 2, wherein said first plug further comprises a hexagonal projection projecting from said plug end face so as to be symmetrical relative to a center axis of said first plug and wherein said at least one contact surface is provided at said hexagonal projection.

6. A transport anchor according to claim 5, wherein said first plug further comprises a blind hole extending from said plug end face into said first plug, said blind hole having an inner thread.

7. A transport anchor according to claim 2, wherein a height of said at least one contact surface in said axial direction is at least 1.1 times the pitch of said outer thread.

8. A transport anchor according to claim 7, wherein said height is 1.5 to 2.0 times said pitch of said outer thread.

9. A transport anchor according to claim 1, wherein said first plug is an injection-molded plastic part and wherein said outer thread has a length of at least two turns.

10. A transport anchor according to claim 1, wherein said plug end face further comprises a marking indicating a thread size of said inner thread of said sleeve.

11. A transport anchor according to claim 1, wherein said inner thread begins at said exterior end face and extends within said first section over a portion of a length of said sleeve and wherein said second section is without said inner thread.

12. A transport anchor according to claim 11, further comprising a second plug positioned at an end of said inner thread adjacent to said second section, said second plug fixedly connected within said sleeve, and wherein said second section has two diametrically opposed bores and wherein said anchoring element is connected to said two diametrically opposed bores.

13. A transport anchor according to claim 1, wherein said inner thread extends over the entire length of said sleeve and wherein said anchoring element is connected to said inner thread provided at said second section.

14. A device for transporting a prefabricated concrete part, said device comprising:

a transport anchor comprising a sleeve for embedding in the prefabricated concrete part, said sleeve having an inner thread;

said transport anchor further comprising a rod-shaped anchoring element for embedding in the prefabricated concrete part;

said sleeve having a first cylindrical section with an exterior end face for positioning flush with an exterior surface of the prefabricated concrete part;

said sleeve having a second section and said anchoring element fixedly connected in said second section;

a first plug having a disk-shaped base body with an outer thread, said first plug threaded into said inner thread of said sleeve;

said first plug comprised of a plastic material;

said first plug having a plug end face facing away form said second section;

said plug end face comprising a marking formed of said plastic material and indicating a load capacity of said transport anchor;

a load bearing member comprising a base body with a first end having an outer thread for threading engagement of said inner thread of the sleeve;

said first end of said base body having an end face with an axial recess;

said plug end face having at least one axial contact surface for engaging said axial recess;

wherein, for connecting and disconnecting said transport anchor and said load bearing member, said axial recess is brought into engagement with said at least one axial contact surface and said base body is turned, thereby axially moving said first plug within said sleeve and threading said first end of said base body into said sleeve and out of said sleeve.

15. A device according to claim 14, wherein said axial recess of said end face of said first end of said base body is a groove extending along a diameter of said base body.

16. A device according to claim 14, wherein said load bearing member further comprises a cable loop, wherein said base body has a second end and is a partially hollow bolt, wherein said second end comprises an opening and wherein said cable loop is fastened to said opening.

17. A device for transporting a prefabricated concrete part, said device comprising:

a transport anchor comprising a sleeve for embedding in the prefabricated concrete part, said sleeve having an inner thread;

said transport anchor further comprising a rod-shaped anchoring element for embedding in the prefabricated concrete part;

said sleeve having a first cylindrical section with an exterior end face for positioning flush with an exterior surface of the prefabricated concrete part;

said sleeve having a second section and said anchoring element fixedly connected in said second section;

a first plug having a disk-shaped base body with an outer thread, said first plug threaded into said inner thread of said sleeve;

said first plug comprised of a plastic material;

said first plug having a plug end face facing away form said second section;

said plug end face comprising a marking formed of said plastic material and indicating a load capacity of said transport anchor;

a load bearing member comprising a base body with a first end having an outer thread for threading engagement of said inner thread of the sleeve;

said first end of said base body having an end face with an axial projection;

said plug end face having at least one axial contact surface for engaging said axial projection;

wherein, for connecting and disconnecting said transport anchor and said load bearing member, said axial projection is brought into engagement with said at least one axial contact surface and said base body is turned, thereby axially moving said first plug within said sleeve and threading said first end of said base body into and out of said sleeve.

18. A device according to claim 17, wherein said load bearing member further comprises a cable loop, wherein said base body has a second end and is a partially hollow bolt, wherein said second end comprises an opening and wherein said cable loop is fastened to said opening.

* * * * *